US005838353A

United States Patent [19]

Choi

[11] Patent Number: 5,838,353

[45] Date of Patent: Nov. 17, 1998

[54] WRITE HEAD CONTAINER FOR INK JET PRINTER

[75] Inventor: Dong-Ha Choi, Kyungki-do, Rep. of Korea

[73] Assignee: SamSung Electronics Co., Ltd., Suwon, Rep. of Korea

[21] Appl. No.: 657,361

[22] Filed: Jun. 3, 1996

[30] Foreign Application Priority Data

Jun. 1, 1995 [KR] Rep. of Korea ..... 95-12468

[51] Int. Cl.[6] ..... B41J 2/75

[52] U.S. Cl. ..... 347/87

[58] Field of Search ..... 347/85–87, 29, 347/49

[56] References Cited

U.S. PATENT DOCUMENTS 4,907,018 3/1990 Pinkerpell et al. ..... 347/87
5,245,361 9/1993 Kashimura et al. ..... 347/87
5,619,239 4/1997 Kotaki et al. ..... 347/86

FOREIGN PATENT DOCUMENTS 3-180354 8/1991 Japan ..... 347/29
5-270002 10/1993 Japan ..... 347/85

*Primary Examiner*—Benjamin R. Fuller
*Assistant Examiner*—Judy Nguyen
*Attorney, Agent, or Firm*—Robert E. Bushnell, Esq.

[57] ABSTRACT

An improved write head container for use with an ink jet printer is provided, in which a constant resilient force is maintained to secure close adhesion between a nozzle of a head and a rubber receptacle, and the tip of the nozzle is prevented from clogging by way of aligning vertical center line of the nozzle and the container. The container is constructed with a locking portion integrally formed with a sidewall so as to lock and unlock the corner of an upper portion of the write head and with a pushing mechanism for maintaining and supporting the close adhesion, which moves up and down through a bottom wall extended from the sidewall.

22 Claims, 2 Drawing Sheets

WRITE HEAD CONTAINER FOR INK JET PRINTER

CROSS REFERENCE TO RELATED APPLICATIONS

This application makes reference to, incorporates herein and claims all benefits accruing under 35 U.S.C. §119 from our application earlier filed in the Korean Industrial Property Office on the 1st day of Jun., 1995 entitled INK JET PRINTER WRITE HEAD CONTAINER, which was duly assigned Utility Model Ser. No. 95-12468 by that Office.

BACKGROUND OF THE INVENTION

The present invention relates in general to a write head container for an ink jet printer, and more particularly, to a write head container having a constant elasticity.

An inkjet printer, as is generally well known in the art, performs an operation of printing or portraying characters and graphics on a recording medium is performed by picture elementary division of characters and portions of graphic images. In a dot matrix manner, each ink droplet is electrified with a voltage at a level corresponding to the location address of an individual pixel, then deflection forces are applied to each charged ink droplet in an electrostatic magnetic field so as to aim the each droplet toward the surface of a recording medium such as a cut sheet of paper.

Generally, such a printer includes a carrier moving in the left or right directions, that is fixedly supported by a main frame of the printer. A head mounted on the carrier ejects ink droplets, a nozzle integrally formed in the head expels the ink droplets in certain designated shapes, a plate that is rotatably installed on the main frame supports and transfers a recording medium during the printing operation, a tight lock plate that is fixedly installed on the main frame pushes the recording medium slightly up to the plate, and a cleaner periodically cleanses the head in response to a signal generated during the printing operation. When a signal is applied to the main frame during the printing mode, the carrier moves in a left or right direction with the head fixedly installed on the carrier.

The nozzle forms certain shapes via its tip according to instructions supplied by a main frame, in response to a signal generated during the printing mode, thereby forming characters and graphic images on the recording medium transferred by a rotation of a plate. When not in use, the write head in an ink jet printer is often kept in a write head container to prevent the ink for the head from drying by blocking the tip of a nozzle so as to permit the ink to enjoy the full span of its life. In addition, a color ink cartridge installed within the write head container may be exchanged as necessary for a mono-color cartridge already in use in the ink jet printer.

A conventional ink container is often constructed with a L-shaped bent, flexible arm that is usually made of synthetic resin, and has a transverse recess formed substantially across the center of the distal limb of the arm to allow the distal end of the limb of the arm a modicum of flexibility to move up and down elastically, against the nozzle of a write head so as to block and tightly lock the lower portion of the head. The elastic flexibility of the distal end of the arm is what enables the close adherence of the distal end against the lower portion of the write head. I have found that when used over a protacted period of time however, the elasticity is gradually lost due to the concentration of force at the junction formed by the transverse groove. This loss causes the rubber receptacle to weaken application of its constant adhesion pressure to the nozzle of the write head, thereby causing the tip of a nozzle to stop-up and the arm to suffer further weakening along the transverse groove. In addition, because the flexible arm is cantilevered, the arm often yields owing to extinction of its flexibility, resulting in misalignment of the nozzle of the write head; I have found that this often detrimentally hinders the normal operational mode of a write head in an ink jet printer.

SUMMARY OF THE INVENTION

It is therefore an object of the present invention to provide an improved write head container for an ink jet printer.

It is another object to provide a write head container having a constant elastic flexibility to allow the nozzle of a write head currently in custody to closely adhere to a rubber receptacle.

It is still another object to provide a write head container minimizing the possibility that the tip of a nozzle of a write head will become stopped-up.

It is still yet another object to provide a write head container enabling alignment between the vertical planes of both the nozzle and write head container.

To achieve these and other objects, there is provided a write head container for an ink jet printer including a locking portion integrally formed on a sidewall of the body of the container so as to elastically lock and unlock an upper comer of a write head and a pushing portion for blocking the tip of a nozzle in a write head and tightly encompassing the nozzle by elastically moving a guide bar upwardly and downwardly through a hole formed at a substantially centered area on the surface of a bottom wall that horizontally extends from the lower portion of a sidewall. A container with this configuration applies constant elastic forces to the upper and lower portions of the write head with both locking and pushing portions so that the nozzle of the write head closely adheres against the rubber receptacle of the pushing portion, with the vertical plane of the nozzle in the write head aligned with a sidewall to prevent the lip of the nozzle from becoming clogged.

The locking portion of the container includes a pair of slots adapted to separate from a sidewall an elastic hinge portion integrally formed with a sidewall arranged to move backwardly and forwardly at the lower portion of the sidewall, a locking tab slidingly extended towards an upper portion of a write head and a locking groove adopted to easily lock and unlock the corner of the upper portion of the sidewall, and a knob extending upwardly from the edge of locking tab. When the write head container is in custody, the corner of an upper portion of the write head is engagingly locked with the locking groove of a locking tab, thereby permitting an elastic hinge to resiliently press downwardly.

To release the write head, the knob is simply drawn in an opposite direction back to an upper portion of the write head so that the comer of the upper portion can be disengaged. The pushing portion includes a guide bar having a rounded flange at its lower portion so as to prevent the guide is bar from being disengaged from the bottom wall of the container, for moving upwardly and downwardly. A rubber receptacle is integrally formed at an upper portion of the guide bar, for blocking and encompassing the nozzle of a write head. An elastic body is positioned between the upper surface of a bottom wall and rubber receptacle so as to push the rubber receptacle into close adhesion with the nozzle of the write head.

Consequently, the pushing portion gives support to the lower portion of a write head in cooperation with the locking portion, thereby maintaining a constant force of adhesion of the rubber receptacle. The rubber receptacle has a hollow formed in substantially a rectangular shape at its center portion so as to receive a nozzle of a write head and to elastically encompass peripheral sidewalls of the nozzle. The upper portion of the rubber receptacle has a slope at each sidewall, in order to reduce its direct contact surface when engaged with a write head, and to thereby enable easy detachment of the write head. A write head container is also provided with a guide rib protrudingly extending from the inner surface of a sidewall and sloping downwardly, for slidingly guiding the lower portion of the write head. A release lug is integrally formed on the edge of another sidewall, opposite to and parallel with the sidewall, with a predetermined angle of inclination toward the sidewall, for enabling easy release of the nozzle of the write head. A knob may be provided on the top surface of the write head to facilitate the easy release of the write head from the container.

BRIEF DESCRIPTION OF THE DRAWINGS

A more complete appreciation of the invention, and many of the attendant advantages thereof will be readily apparent as the same becomes better understood by reference to the following detailed description who-an considered in conjunction with the accompanying drawings in which like reference symbols indicate the same or similar components, wherein.

DETAILED DESCRIPTION OF THE PREFERRED EMBODIMENT

Figure 1:
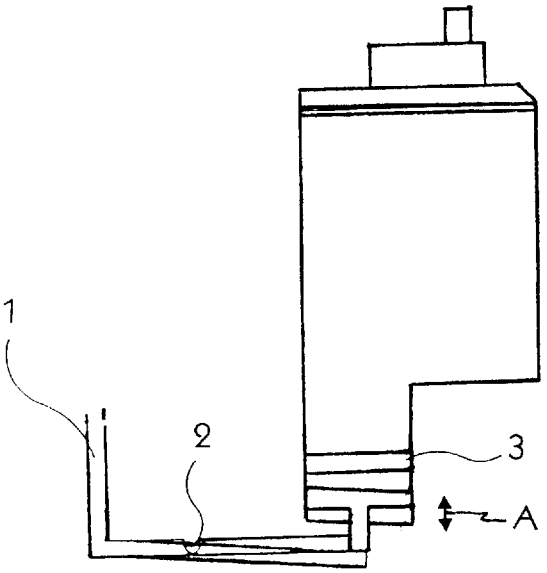
(Prior Art) FIG. 1
FIG. 1 is a side view illustrating a hypothetical representation of a conventionally constructed configuration for a write head container of an ink jet printer.

Turning now to the drawings, FIG. 1 illustrates a representation of the salient features of a conventionally constructed ink container of the type which is often constructed with a supporter 1 usually made of synthetic resins, having a transverse groove 2 formed substantially at the center portion of the distal bent flexible arm, so as to allow the free distal end of the arm to move up and down elastically, thereby securing close adhesion to the nozzle of a write head, and a rubber receptacle 3 integrally formed at the edge of banded flexible arm of supporter 1 so as to block and tightly lock the lower portion of the write head. The elastic flexibility of supporter 1 makes rubber receptacle 3 block and closely adhere to the nozzle of the write head. When used over a protracted period however, the elastic flexibility is gradually weakened due to plastic strain occurring at transverse groove 2, thereby allowing rubber receptacle 3 to loose the application of its constant adhesion pressure to the nozzle of the write head, thus causing the tip of the nozzle to become stopped-up and groove 2 to be damaged. In addition, supporter 1, which is inherently cantilevered, often yields owing to the gradual extinction of its flexibility, thereby resulting in misalignment of the nozzle of the write head, a fact that I have found often hinders the normal operational mode of the write head in an ink jet printer.

Figure 2:
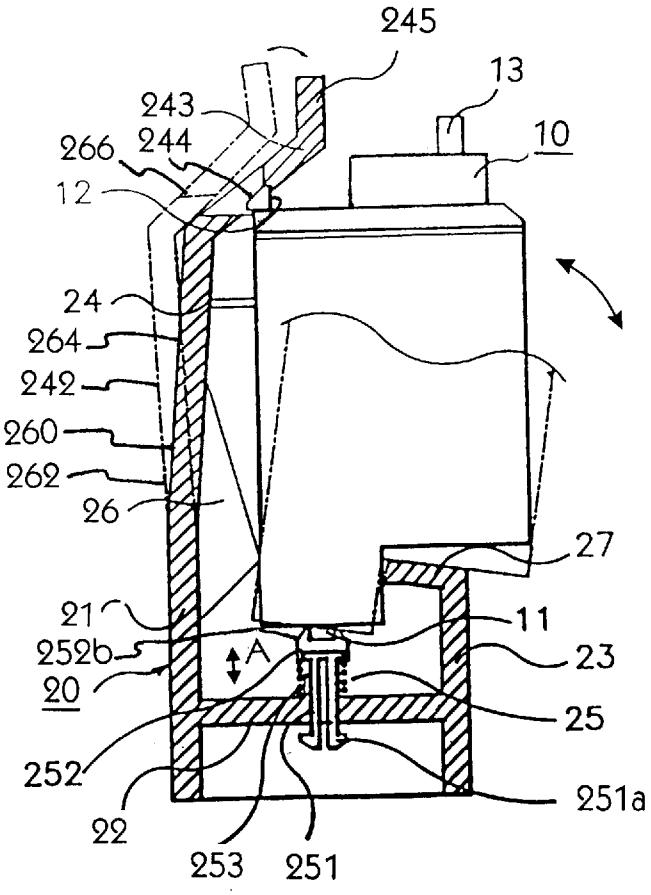
FIG. 2 is a schematic sectional view of one preferred embodiment of a write head container constructed according to the principles of the present invention.
Figure 3:
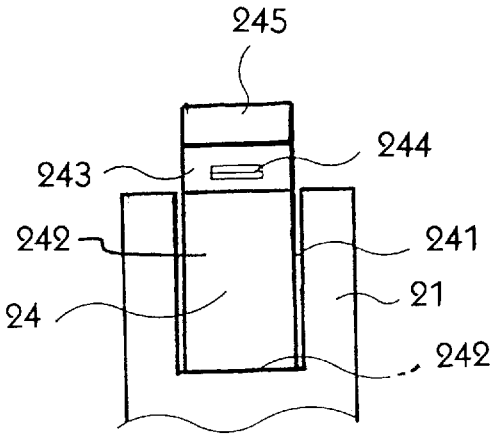
FIG. 3 is a back elevational view of a locking portion of one preferred embodiment of a write head container constructed according to the principles of the present invention.

Referring now to FIGS. 2 and 3, a write head container for use with an ink jet printer according to the principles of the present invention may be constructed with locking portion 24 integrally formed on a sidewall 21 of body 20 of the container so as to lock and unlock the corner of the upper portion of head 10 in an elastically flexible manner and pushing mechanism 25 installed through substantially the center portion of a bottom wall 22 of body 20 of the container. Bottom wall 22 is formed integrally with and extends horizontally from the lower portion of sidewall 21, and is adapted to tightly block and encompass nozzle 11 of write head 10 by way of an elastic deformation and reciprocating movement in an up and down direction as indicated by arrow A.

Locking portion 24 of body 20 of the container is formed with a pair of substantially parallel, slots 241 placed to separate opposite longitudinal sides of locking portion 24 from sidewall 21. Elastic hinge 242 having a first intermediate section 264 and a second intermediate section 266, is integrally formed on sidewall 21, with a lower side 260 joined at a manually deformable junction 262 to sidewall 21 to allow an elastic movement in the front and rear direction (i.e., in and out of the plane of sidewall 21). Locking tab 243 has groove 244 for easily engaging and thereby locking, and unlocking, a corner 12 of upper portion of head 10. A distal lever 245 extends from the uppermost edge of locking tab 243, and protrudes upwardly adjacent to head 10. Lever 245 is integrally formed with locking tab 243, and extends upwardly at a right angle to the bottom, to provide a user with a lever enabling easy manipulation of locking tab 243 to perform locking and unlocking operations. A spring-loaded cap, constructed as pushing mechanism 25 is constructed with guide bar 251 having rounded slide flange 251 *a* which secures an engagement of guide bar 251 within bottom wall 22 of body 20, in order to accommodate reciprocating movement in the vertical direction relative to bottom wall 22.

Figure 4:
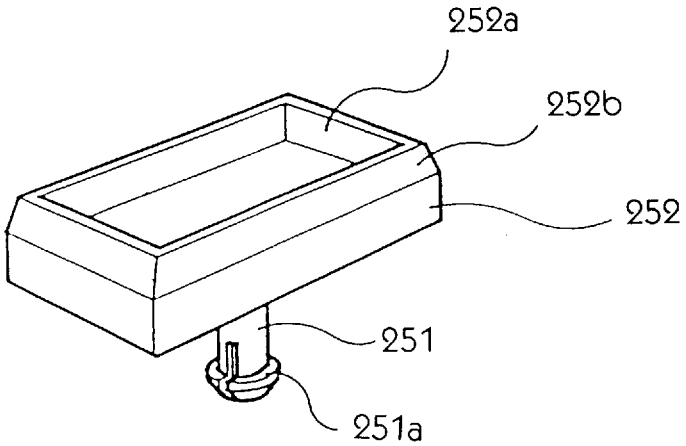
FIG. 4 is a perspective view of a receptacle of one preferred embodiment of a write head container constructed according to the principles of the present invention.

Referring now to FIGS. 2, 3 and 4, a rubber receptacle 252 is located on an upper portion of guide bar 251 and is adapted to block and encompassing nozzle 11 of head 10. An elastic body 253 (e.g., a spring) is flexibly installed between the upper surface of bottom wall 22 and the bottom surface of rubber receptacle 252, for biasing and thereby sustaining rubber receptacle 252 to maintain a constant compressive force against nozzle 11 of head 10. A coiled compressed spring may be employed as elastic body 253 in an exemplar in this arrangement of one preferred embodiment of the instant invention; however, the practice is not limited thereto, and another resilient component of same nature and effect may be substituted.

As shown in FIG. 4, rubber receptacle 252 is provided with a hollow trough 252*a* having a substantially rectangular shape generally formed in its central area so as to receive nozzle 11 of head 10 and to encompass the periphery of nozzle 11. The upper portion of rubber receptacle 252 is provided with a beveled chamfer 252*b* so as to reduce the size of the area in direct contact, thereby allowing head 10 to separate smoothly from receptacle 252. Referring again to FIGS. 2 and 3, guide rib 26 protrudes from the inner side of sidewall 21 and is arranged to decline downwardly to provide a path for guiding the lowermost portion of head 10 along the its apex.

Also provided at the upper portion of another sidewall 23 integrally formed at an end of bottom wall 22 and located opposite from sidewall 21, is a lug 27 for releasing head 10. As a result, head 10 is locked and unlocked by simple combined operation of both guide rib 26 and release lug 27. A knob 13 may be integrally installed on the top surface of write head 10 so as to facilitate an user's manipulation of write head 10 while unlocking head 10. To secure close adhesion between nozzle 11 of head 10 while head 10 is within the custody of body 20 and pushing mechanism 25 of a container, locking portion 24 and pushing mechanism 25 cooperatively support respective upper and lower portions of write head 10 so as to produce a constant elastic compressive force that aligns the center line of nozzle 11 of head 10 with a plane defined by sidewall 21 (as distinguished from the plane defined by locking tongue 24), thereby preventing the tip of nozzle 11 from becoming stopped-up (e.g., through clogging due to leaking and subsequent drying of ink from an obliquely seated nozzle 11).

More specifically, when mounting head 10 within body of a container, the apex of guide rib 26, which is formed as an integral part of side wall 21, guides head 10 downwardly, as shown by the phantom lines in FIG. 2, so as to receive and to engagedly lock the corner 12 of upper portion into groove 244 of locking tab 243 as seen in solid lines and elastic hinge 242 applied a pressing force on to the corner 12. When hollow trough 252*a* of rubber receptacle 25 in pushing mechanism 25 receives nozzle 11 of head 10, elastic body 253 is first compressed despite of its resilience, allowing rubber receptacle 252 to slightly move downwardly, and is then stopped when the corner 12 of the upper portion of head 10 is locked in groove 244. The resilience of elastic body 253 supports the lower portion of head 10 while simultaneously pushing up the bottom wall of rubber receptacle 252, thereby securing tight and aligned contact between nozzle 11 and pushing mechanism 25.

The achievement of parallel alignment between the center line of nozzle 11 of head 10 and the vertical surfaces of sidewall 21 of the body 20, prevents the tip of nozzle 11 from clogging. Referring again to FIG. 2, when head 10 is mounted within body 20 as shown by the phantom lines, the lower portion of head 10 is in contact with and slidingly guided downwardly along the upper slope of guide rib 26 protruding from the inner surface of sidewall 21 so that head 10 maintains its upright posture during insertion into body 20. Guide rib 26 protrudes from an inner surface of sidewall 21 and is oriented to incline downwardly and guide the lowermost portion of head 10 during insertion of head 10 into container 20, while lug 27, with its distal end extending inwardly toward the apex of guide rib 26, has an obliquely upwardly slope extending from an upper edge of side wall 23 integrally formed with an end of bottom wall 22, restricts deviation in orientation of head 10 within container 20 by engaging the lowermost portion of head 10 in cooperation with the apex of guide rib 26 both during insertion of head 10 into container 20 and during removal of head 10 from container 20; together guide rib 26 and the distal end of lug 27 mutually engage opposite sides of the lowermost portion of head 10 during its residency within container 20, and maintaining the upright orientation of head 10 while locking tab 243 maintains engagement of the upper corner 12 of write head 10, with the centerline of nozzle 11 being coaxially aligned with the centerline of reciprocation of guide bar 251 and parallel to a plane defined by the surfaces of sidewall 23.

It may also be noted that release lug 27 prevents head 10 from deviating from its upright orientation within the container, thereby assuring proper installation. Once corner 12 of head 10 is released from groove 244 of locking tab 243 by pulling lever 245 backwards in a direction from the solid lines to the phantom lines in FIG. 2, by a user's manipulation of lever 245, elastic body 253 then uncompresses upwardly to push rubber receptacle 252 upwardly, thereby enabling head 10 to be ejected from body 20.

To alternatively release head 10 from body 20, knob 13 may be pulled over to the direction as indicated by a transition from the solid lines of head 10 to the phantom lines (e.g., to the right in FIG. 2), turning the lowermost portion of write head 10 against the edge of release lug 27 as a lever and support point, thereby enabling corner 12 of nozzle 11 of head 10 to be released from trough 252*a* of rubber receptacle 252.

As above stated, an improved container constructed according to the principles of the instant invention produces a constant compressive elasticity to secure a close adhesion between the nozzle of a head and rubber receptacle and simultaneously prevents the tip of a nozzle from being clogged by way of aligning vertical center lines of nozzle and container. The container for the write head is particularly suited for an ink jet printer, and has a constant elasticity so as to assure the close adhesion of the nozzle to the rubber receptacle of the container while in the custody of a rubber receptacle, thereby simultaneously preventing the tip of write head from being clogged by way of aligning the nozzle of the write head at a right angle with the bottom plane of the container.

While there have been illustrated and described what are considered to be embodiments of the present invention, it will be understood by those skilled in the art that various changes and modifications may be make, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A write head container accommodating a write head having a first side portion, a second side portion, a central portion, a width and a nozzle having a tip projecting from said first side portion of the write head for emitting ink, said first side portion including a first sidewall and an opposing second sidewall, said second side portion spaced-apart from said first side portion by said central portion, said central portion bearing ink for use with an ink jet printer, comprising:

a first sidewall exhibiting a first length and having a width greater than the width of the write head, said first sidewall being provided with a recessed opening that defines a junction;

a bottom wall extending transversely to said first sidewall;

a second sidewall exhibiting a second and lesser length than the first length of said first sidewall extending transversely across said bottom wall to define a cavity accommodating entrance of the nozzle;

a lug extending from one end of said second sidewall inwardly toward said first sidewall and terminating said one end of said second sidewall by engaging the first sidewall of the first side portion of the write head and maintaining the nozzle at a fixed distance spaced-apart from said bottom wall;

a locking portion integrally formed at said junction within said recessed opening of said first sidewall, said locking portion having a first intermediate section, a second intermediate section, a proximal end joined at said junction, and a distal end separated from said junction by said first intermediate section joined to said second intermediate section, said second intermediate section extending inwardly from said first intermediate section in a direction toward said second sidewall and having a groove formed therein retentively accommodating entry of an extreme corner of the second side portion of the write head, said distal end being manually rotatable about said junction and away from said lug in conjunction with said first intermediate section and said second intermediate section;

said first sidewall, said bottom wall, said second sidewall, and said locking portion comprising a single monolithic and integrated one-piece structure; and a spring-loaded cap supported and movably retained within said cavity by said bottom wall of said structure, said spring-loaded cap blocking and encompassing the nozzle of the write head, said spring-loaded cap moving reciprocally through an aperture positioned within said bottom wall at a location spaced between said first sidewall and said second sidewall, to reciprocate within said fixed distance relative to said bottom wall and surround the nozzle while the nozzle protrudes into said fixed distance and said lug engages the first sidewall of the first side portion and while said second intermediate section maintains the corner of the write head within said groove.

2. The write head container according to claim 1, wherein said recessed opening accommodating said locking portion to manual displace said locking portion.

3. The write head container according to claim 1, wherein said spring-loaded cap comprises:

a guide bar having a distal end, a proximal end, and a rounded flange exhibiting an outermost diameter greater than a diameter of said aperture, and terminating said distal end of said guide bar;

a receptacle made of a resilient material integrally formed with said proximal end of said guide bar; and a spring biasing said receptacle to engage the nozzle of the write head.

4. A write head container according to claim 1, further comprising:

a rib protruding from an inner surface of said first sidewall toward, but spaced-apart from said second sidewall, and oriented to incline downwardly and guide said first side portion of the head toward said bottom wall during insertion of the head into said container; and said lug having a distal end extending inwardly toward said rib, said lug having an oblique upward slope extending from said one end of said second sidewall integrally formed with an end of said bottom wall, said lug restricting deviation in orientation of the head within said container by engaging said second sidewall of the first side portion of the head in cooperation with said rib during insertion of the head into said container and during removal of the write head from said container, and maintaining said orientation while said locking portion maintains engagement of the corner.

5. The write head container of claim 1, wherein said spring-loaded cap comprises:

a guide disposed within said aperture;

an elastic body mounted on said guide;

a beveled chamfer of a resilient material forming a periphery extending from said elastic body to define an exposed hollow central trough; and a compressible component biasing said elastic body to position said chamfer around the nozzle as the nozzle protrudes into said fixed distance.

6. The write head of claim 1, wherein said spring-loaded cap comprises:

an elastic body;

a beveled chamfer of a resilient material forming a periphery around said elastic body to define an exposed central region of said elastic body; and a compressible component biasing said elastic body to position said chamfer around the nozzle.

7. The container of claim 1, wherein said lug is permanently fixed to said second sidewall.

8. The write head container according to claim 1, wherein said bottom wall joins said first sidewall.

9. The write head container according to claim 1, wherein said bottom wall extends between said first sidewall and said second sidewall.

10. The write head container according to claim 1, wherein said bottom wall joins both said first sidewall and second sidewall.

11. The write head container according to claim 1, wherein said bottom wall joins said second sidewall.

12. A write head container according to claim 3, wherein said receptacle is formed with a hollow trough having a substantially rectangular shape configured to conform to and receive the nozzle of the write head.

13. A write head container according to claim 3, wherein:

said receptacle is formed with a centrally positioned hollow trough disposed to receive and close the nozzle, said trough having a beveled peripheral edge.

14. A white head container according to claim 12, wherein said hollow trough having a beveled peripheral edge.

15. A write head container according to claim 4, wherein said rib and said lug disposed on opposite sides of the write head, to align the nozzle of the write head relative to said bottom wall.

16. A write head container accommodating a write head exhibiting a width and having a first side portion, a second side portion, a central portion and a nozzle including a tip projecting from said first side portion of the write head for emitting ink, said first side portion include a first sidewall and an opposing second sidewall, said second side portion spaced-part from said first side portion by said central portion, said central portion bearing ink for use with an ink jet printer, comprising:

a first sidewall exhibiting a first length, said first sidewall being provided with a recessed opening that defines a junction;

a bottom wall extending transversely to said first sidewall having an aperture;

a second sidewall exhibiting a second and lesser length than the first length of said first sidewall extending transversely across said bottom wall to define a cavity accommodating the nozzle;

a lug extending inwardly from said second sidewall toward said first sidewall, said lug engaging the first sidewall of the first portion of the write head while maintaining the nozzle spaced-apart from said bottom wall;

a manually movable latch integrally formed with said first sidewall, said latch comprising a first intermediate section, a second intermediate section, a proximal end joined at said junction within said recessed opening of said first sidewall, and a distal end separated from said junction by said first intermediate section joined to said second intermediate section, said second intermediate section extending inwardly from said first intermediate section in a direction, toward said second sidewall across said cavity and having a groove formed therein, said latch rotating about said junction in response to manual displacement of said distal end of said latch outwardly from said cavity and being biased to return inwardly toward said cavity upon release from said manual displacement to enable said groove to retentively engage the second side portion of the write head, said distal end being manually rotatable about said junction and away from said lug in unison with said first intermediate section and said second intermediate sections; and a spring-loaded cap comprising a guide and resilient receptacle supported by said guide, said spring-loaded cap being supported by said bottom wall within said cavity, said guide positioning said receptacle to receive and encompass a periphery of the nozzle, said spring-loaded cap moving reciprocally through said aperture in said bottom wall at a location spaced between said first sidewall and said second sidewall, to reciprocate relative to said bottom wall between the nozzle of the write head and said bottom wall and to receive and surround the nozzle while said lug engages the first sidewall of said first portion side and while said second intermediate section maintains the write head within said groove.

17. The write head container of claim 16, wherein said receptacle comprises an elastic body mounted on said guide, and beveled chamfer forming a periphery extending from said elastic body and defining a hollow trough.

18. The write head container according to claim 16, wherein said bottom wall joins said first sidewall.

19. A write head container accommodating a write head having a lower portion, an upper corner, opposing from said lower portion, and a nozzle projecting from said lower portion for emitting ink for use an ink jet printer, comprising:

a first sidewall exhibiting a first length, said first sidewall being provided with a recessed opening that defines a junction;

a bottom wall extending transversely toward said first sidewall;

a second sidewall exhibiting a second and lesser length than the first length of said first sidewall extending transversely across said bottom wall to define a cavity located between said first sidewall and said second sidewall;

a lug extending from one end of said second sidewall inwardly toward said first sidewall and terminating said one end of said second sidewall by engaging the lower portion of the write head and maintaining the nozzle at a fixed distance spaced-apart from said bottom wall;

a locking portion integrally formed at said junction within said recessed opening of said first sidewall, said locking portion having a proximal end joined at said junction and a distal end spaced-apart from said junction, said distal end extending inwardly in a direction toward said second sidewall and having a groove formed therein oriented to face toward said cavity and retentively accommodate entry of said upper corner of the write head, said distal end being manually rotatable about said junction and away from said lug in conjunction with said groove;

said first sidewall, said bottom wall, said second sidewall, and said locking portion comprising a single monolithic and integrated one-piece structure; and a spring-loaded cap supported and movably retained within said cavity by said bottom wall of said structure, said spring-loaded cap blocking and encompassing the nozzle, said spring-loaded cap moving reciprocally through an aperture centrally positioned within said bottom wall at a location spaced between said first sidewall and said second sidewall, to reciprocate within said fixed distance relative to said bottom wall and surround the nozzle while the nozzle protrudes into said fixed distance and said lug engages the lower portion of the write head and while said locking portion maintains the write head within said groove.

20. The write head container according to claim 19, wherein said bottom wall joins said first sidewall.

21. The write head container according to claim 19, wherein said bottom wall extends between said first sidewall and said second sidewall.

22. The write head container according to claim 19, wherein said bottom wall joins both said first sidewall and said second sidewall.

* * * * *